US005613874A

United States Patent [19]

Orlando et al.

[11] Patent Number: 5,613,874

[45] Date of Patent: Mar. 25, 1997

[54] SNAP-IN DESIGNATION STRIP FOR MODULAR INFORMATION MANAGEMENT OULET

[75] Inventors: Stephen A. Orlando, Longboat Key, Fla.; Walter Schwer, Westerly, R.I.

[73] Assignee: Ortronics Inc., Pawcatuck, Conn.

[21] Appl. No.: 435,824

[22] Filed: May 5, 1995

[51] Int. Cl.[6] ..... H01R 3/00

[52] U.S. Cl. ..... 439/491; 40/611; 40/642.02

[58] Field of Search ..... 439/491, 536, 439/488; 40/611, 642, 649

[56] References Cited

U.S. PATENT DOCUMENTS 3,921,798 11/1975 Dean et al. ..... 40/642

5,080,607 1/1992 Cristescu ..... 439/491

*Primary Examiner*—P. Austin Bradley

*Assistant Examiner*—Yong Kim

*Attorney, Agent, or Firm*—St. Onge Steward Johnston & Reens LLC

[57] ABSTRACT

A snap-in designation strip and a modular information management outlet assembly including the snap-in designation strip facilitate the simple and accurate designation of the source of each outlet. The snap-in designation strip comprises a rectangular base, top and bottom rails each including a groove for receiving a label, and an attachment tab extending from the back surface of the base. The assembly includes an outlet module having at least one connector located on a front face, a slot above the connector, and a designation strip wherein the attachment tab is inserted into the slot.

12 Claims, 1 Drawing Sheet

SNAP-IN DESIGNATION STRIP FOR MODULAR INFORMATION MANAGEMENT OULET

TECHNICAL FIELD

The invention relates to improvements in information management outlet modules and assemblies including them. In particular, the invention provides a snap-in designation strip for a modular information management outlet, which can contain connector modules of the RJ-type, fiber optic and coaxial, and other conventional communication connections.

Communications technology (including data, audio, video and voice processing and transmission) is placing ever-increasing demands on wire management systems and the personnel responsible for their installation and maintenance. The design of all system components must be done with attention to system integrity and ease of performance of associated manual tasks.

Efficient wire management requires convenient access to equipment and rapid, accurate connection and disconnection, and, therefore, simple and flexible designation—often of several individual services (e.g., electronic data processing, telecommunications, and video) and frequently of several different kinds of cabling. Current technology does not provide the desired degree of ease of identifying the various outlets.

BACKGROUND ART

The art generally has provided a number of techniques and devices to designate the source of wires for communication connectors, but none has been devised for the purpose that is secure, easy to install and update, while providing reliable, customized information.

Among the connector designation means available to the art are snap-in plastic tabs in a variety of colors and with an intaglio or relief symbol representing, generally, a type of service, such as telephone, computer, or video. Snap-in plastic tabs of this type are shown in U.S. Pat. No. 5,362,254 to Siemon, et al. and have been made to be positioned above an individual connector or above the connector with a depending extension which covers the connector opening. Connectors of the RJ type are shown in the above Siemon, et al. patent, and the entire disclosure of that patent is hereby incorporated by reference. Plastic tags visually similar to those shown in that patent, have also been made to snap into slots located above connectors.

Because the known designation plastic tabs do not permit the presentation of information as to the specific use or source of a connector, it has been the practice of many installation technicians to apply a plastic adhesive label which is embossed with the information. It has also been the practice of many to simply put a strip of paper or cloth tape on the module and then write the designation information on the tape.

There is a need for a designation strip for a modular information management outlet, which can contain connector modules of the RJ-type, fiber optic and coaxial, and other conventional communication connections which is convenient to use and provides simple and secure, yet flexible, designation.

DISCLOSURE OF THE INVENTION

It is an object of the invention to provide a simple, secure and flexible means for identifying the source and/or use of cabling to a modular information management outlet.

It is another object of the invention to provide a modular connector assembly including improved means for identifying the source and/or use of cabling to a modular information management outlet.

It is another and still more specific object of the invention to provide an outlet module including simple, secure and flexible means for identifying the source and/or use of cabling to a modular information management outlet wherein the identification can be specific, customized and done on the site by the installation technician.

These and other objects are achieved by the present invention which provides both a snap-in designation strip and a modular information management outlet assembly including the snap-in designation strip.

The snap-in designation strip comprises: a rectangular planar base having front and back surfaces, a top, a bottom, and two side edges on opposite sides of the planar base extending from the top to the bottom; a top rail attached to the front surface of the base at the top thereof and including a downwardly-opening groove along its length; a bottom rail attached to the front surface of the base at the bottom thereof and including an upwardly-opening groove along its length; and an attachment tab extending from the back surface of the base. In its preferred form, the designation strip will include a label, preferably of paper and overlaid with a clear-plastic cover, held to the front surface by the top and bottom rails. The attachment tab preferably provides a snap-fit with a slot in an information management outlet module above the outlet or connector. In one preferred form, the attachment tab comprises two flexible arms extended from the back surface of the base, each of said arms terminated by a tip which increases in dimension from its terminus to a stepped-in portion between the terminus and the base.

The assembly will include an outlet module comprising a front face having at least one connector located thereon and a slot positioned above said connector; and a designation strip as defined above wherein the attachment tab is inserted into said slot.

BRIEF DESCRIPTION OF THE DRAWINGS

The invention will be better understood and its advantages will be better appreciated from the following detailed description, especially when read in light of the accompanying drawings, wherein.

INDUSTRIAL APPLICABILITY

Figures 1, 2, 3:
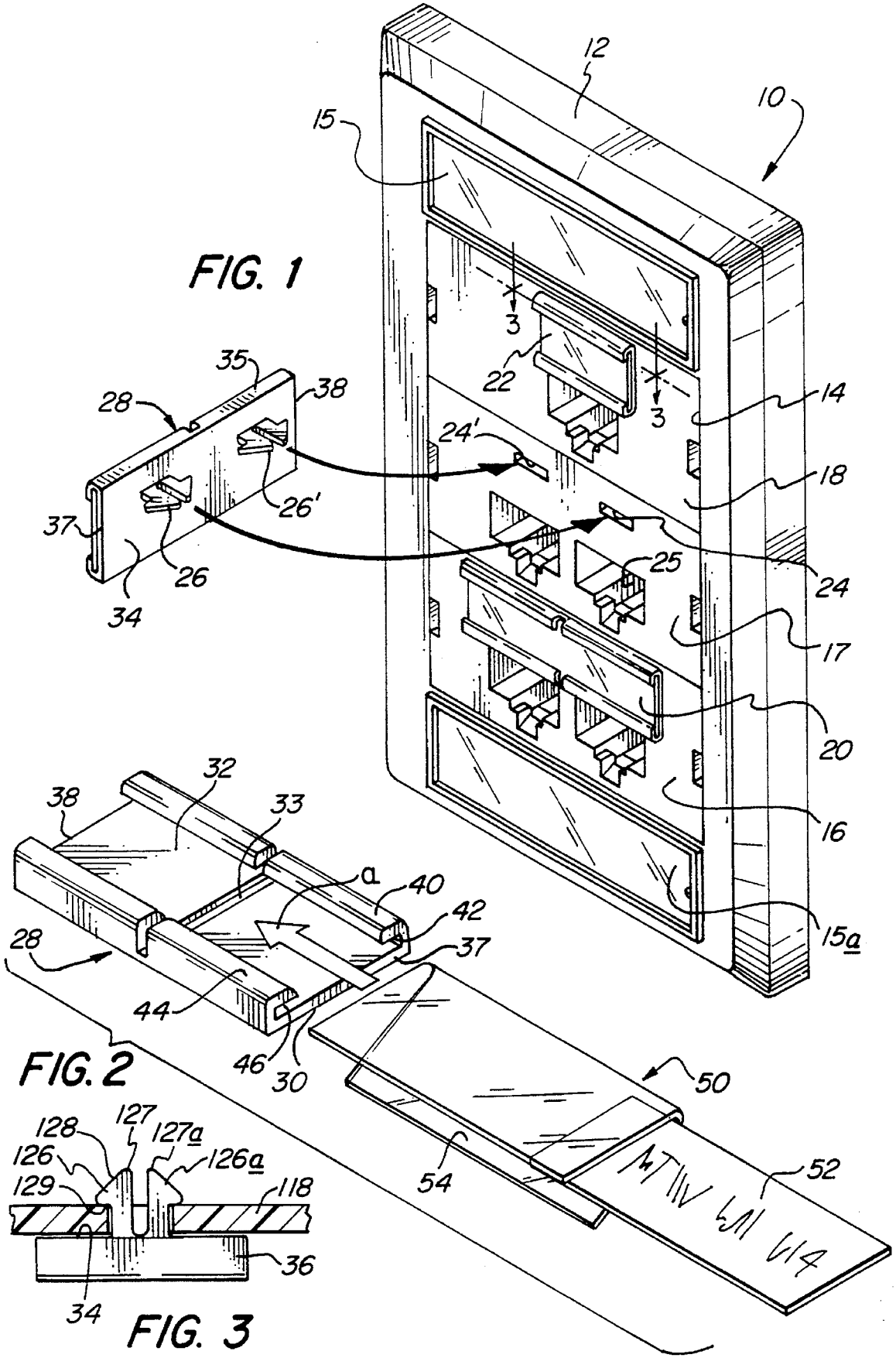
FIG. 1 is a perspective view, partially exploded, showing snap-in designation strips for a plurality of outlets in a modular information management outlet assembly.
FIG. 2 is a perspective view, partially exploded, showing the component parts of a snap-in designation strip of the invention.
FIG. 3 is a cross sectional view, partially exploded, taken along line 3—3 in FIG. 1, showing the preferred manner of attachment of a strip to a module.

The improvements of the invention have application to the field of connections employing modular connector outlets of all types, including the RJ-type, fiber optic, coaxial, audio, FDDI, and the like. The term "RJ-type connector" is defined herein to include, specifically, the various modular communication connectors assigned RJ numbers according to the USOC. Fiber optic connectors can be of the SC, the ST, or other configurations. The coaxial connectors can be of the BNC, the F, the Keystone, the IBM® data module, or other suitable configurations. The invention facilitates the identification of connectors of most types for modern information management systems, and is not limited to any particular type of connector. The invention is of particular advantage where the art has not provided suitable identification means or has restricted them in terms of format and available information.

The drawings are intended to depict outlets of the RJ-45 type, but the invention is not limited to such. The description will refer to various parts by their usual orientation (e.g., front, back, top and bottom), however, this is done for ease of description and is not meant to limit the orientation of the devices in actual use.

FIG. 1 shows an information management outlet assembly, generally as 10, which includes a faceplate 12 having an opening therein outlined by parting line 14. The opening is shown to be filled by three outlet modules, double outlet module 16, double outlet module 17 and single outlet module 18. The faceplate is also shown to include two identification plates 15 and 15*a*, forming no part of the invention. All but of the openings in the faceplate are shown to be occupied with a connector module 18 according to the invention. Each of the RJ-type connector modules 16 and 18 is fitted with a designation strip, 20 and 22, respectively. Connector 17 is shown as having slots 24, 24' for receiving snap-in fasteners 26, 26' on designation strip 28.

FIGS. 2 and 3 show the detail of assembly of the designation strip 28, in this case sized appropriately for a double RJ-type connector module. The snap-in designation strip 28 is shown to include a rectangular planar base 30 having a front surface 32, a back surface 34 (see FIG. 1), a top 35, a bottom 36, and two side edges 37 and 38 on opposite sides of the planar base and extending from the top to the bottom. In the embodiment shown, a groove 33 is molded into the front surface 32 of the base 30 to permit a double strip to be broken easily into two single strips.

A top rail 40 is attached to the front surface 32 of the base 30 at the top 35 thereof. The top rail 40 includes a downwardly-opening groove 42 along its length. A bottom rail 42 is attached to the front surface 32 of the base 30 at the bottom thereof and includes an upwardly-opening groove 46 along its length. The groove 42 faces the groove 46 in such a manner that they can hold a label therein against the front surface 32 of the base 30. FIG. 2 illustrates the insertion of a two-piece label assembly 50. In this preferred form, the label assembly 50 is inserted such as in the direction of arrow a to complete the assembly of the designation strip 28. Label assembly 50 includes a label 52, preferably of paper, overlaid with a clear-plastic cover 54, held to the front surface by the grooves in the top and bottom rails 40 and 44. Again, as with the provision of groove 33 in front surface 32, the rails 40 and 44 are shown to be parted to permit easy breaking of the strip into two functional pieces.

FIG. 1 shows two attachment tabs 26 and 26' extending from the back surface 34 of the base 30. The attachment tabs preferably provide a snap-fit with complementary slots, e.g. 24 and 24', in an information management outlet module 18 above the outlet or connector, in this case an RJ-type connector outlet. In one preferred form, the attachment tab (seen best in FIG. 3) comprises two flexible arms 126 and 126*a* which extend from the back surface 34 of the base 30. Each of arms 126 and 126*a* is terminated by a tip which increases in dimension from its terminus (127 and 127*a* respectively) to a stepped-in portion between the terminus and the base.

In the embodiment of the attachment tabs shown, each of the two arms 126 and 126*a* is a mirror image of the other, and the tip of arm 126 is shown to have a chamfered surface 128 which extends from the terminus 127 to a stepped-in edge 129. In operation, as the tab 26 is inserted into a slot, such as 24, the chamfered or otherwise suitably beveled or rounded tip bends arms 126 and 126*a* toward each other until they pass through the wall 118 of module 18. Once through the wall 118, the arms resiliently resume their original configuration. It will be understood that the arms can have any suitable shape, including one with a common base which is unitary at the point of connection to base 30, but is then bifurcated as it extends outwardly. Because it is required that the arms be resilient, it is preferable to mold unitary tabs 26, base 30 and rails 40 and 44 in one piece of a suitably resilient plastic material such as a high density polyolefin, e.g., polypropylene.

The assembly will include an outlet module, such as 18, of which only the front face is seen in FIG. 1. The module will have at least one connector, such as 25, located thereon and a slot, such as 24, positioned above the connector with a designation strip as defined above.

The above description is for the purpose of teaching the person of ordinary skill in the art how to practice the invention, and it is not intended to detail all of those obvious modifications and variations of it which will become apparent to the skilled worker upon reading the description. It is intended, however, that all such obvious modifications and variations be included within the scope of the invention which is defined by the following claims. The claims are meant to cover the claimed elements and steps in any arrangement or sequence which is effective to meet the objectives there intended, unless the context specifically indicates the contrary.

We claim:

1. A snap-in designation strip comprising: a rectangular planar base having a front surface and a substantially planar back surface so as to enable the strip back surface to be substantially flush mounted to a front surface of an outlet module, said base further having a top, a bottom, and two side edges on opposite sides of the planar base extending from the top to the bottom; a top rail attached to the front surface of the base at the top thereof and including a downwardly-opening groove along its length; a bottom rail attached to the front surface of the base at the bottom thereof and including an upwardly-opening groove along its length; and a resilient attachment tab extending from the substantially planar back surface of the base, said attachment tab being sized to fit with interference through a slot in said outlet module and having at least one stepped edge for interlocking engagement with a wall of said outlet module surrounding said slot.

2. A snap-in designation strip according to claim 1 which further includes a label held to the front surface of the planar base by the top and bottom rails and wherein said back surface of the base has at least one pair of said attachment tabs, with said tabs being closely spaced and oppositely oriented so that their respective stepped edges interlockingly engage opposite portions of the wall surrounding the slot in an outlet module.

3. A snap-in designation strip according to claim 2 wherein said label is comprised of paper and is overlaid with a clear-plastic cover.

4. A snap-in designation strip for an outlet module comprising: a rectangular planar base having front and back surfaces, a top, a bottom, and two side edges on opposite sides of the planar base extending from the top to the bottom; a top rail attached to the front surface of the base at the top thereof and including a downwardly-opening groove along its length; a bottom rail attached to the front surface of the base at the bottom thereof and including an upwardly-opening groove along its length; and an attachment tab extending from the back surface of the base wherein the attachment tab comprises two flexible arms extended from the back surface of the base, each of said arms terminated by a tip which increases in dimension from its terminus to a stepped-in portion between the terminus and the base so as to fit with interference within a slot of a front wall of the outlet module.

5. A snap-in designation strip comprising: a rectangular planar base having a front surface and a substantially flat back surface, a top, a bottom, and two side edges on opposite sides of the planar base extending from the top to the bottom; a top rail attached to the front surface of the base at the top thereof and including a downwardly-opening groove along its length; a bottom rail attached to the front surface of the base at the bottom thereof and including an upwardly-opening groove along its length; a label comprised of paper and overlaid with a clear-plastic cover, held to the front surface of the planar base by the top and bottom rails; and an attachment tab extending from the back surface of the base, said tab comprising two flexible arms extended from the back surface of the base, each of said arms terminated by a tip which increases in dimension from its terminus to a stepped-in portion between the terminus and the base, with said arms being oppositely oriented so as to enable their respective stepped-in portions to engage opposite wall segments of a slot in an outlet module to which the designation strip can be mounted.

6. A communications connection assembly comprising:

an outlet module including a front face having at least one connector located thereon and a slot positioned above said connector; and a designation strip including a rectangular planar base having front and back surfaces, a top, a bottom, and two side edges on opposite sides of the planar base extending from the top to the bottom;

a top rail attached to the front surface of the base at the top thereof and including a downwardly-opening groove along its length;

a bottom rail attached to the front surface of the base at the bottom thereof and including an upwardly-opening groove along its length;

and an attachment tab extending from the back surface of the base;

wherein said attachment tab is inserted into said slot.

7. A communications connection assembly according to claim 6 which further includes a label held to the front surface of the planar base by the top and bottom rails.

8. A communications connection assembly according to claim 6 wherein said label is comprised of paper and is overlaid with a clear-plastic cover.

9. A communications connection assembly according to claim 6 wherein the attachment tab comprises two flexible arms extended from the back surface of the base, each of said arms terminated by a tip which increases in dimension from its terminus to a stepped-in portion between the terminus and the base.

10. A communications connection assembly according to claim 6 wherein the connector is of the RJ-type.

11. A communications connection assembly according to claim 6 wherein the connector is of the coaxial type.

12. A communications connection assembly according to claim 6 wherein the connector is of the fiber optic type.

* * * * *